United States Patent [19]

Nakayama et al.

[11] 4,307,998

[45] Dec. 29, 1981

[54] SWASH-PLATE-TYPE COMPRESSOR FOR AIR-CONDITIONING VEHICLES

[75] Inventors: Shozo Nakayama; Kimio Kato; Takamitu Mukai; Tomoo Fujii; Hiroya Kono, all of Kariya; Tatsuhiko Fukuoka, Toyota; Eizi Asada, Okazaki; Kenichiro Futamura, Toyota, all of Japan

[73] Assignees: Kabushiki Kaisha Toyoda Jidoshokki Seisakusho; Taiho Kogyo Kabushiki Kaisha, both of Aichi, Japan

[21] Appl. No.: 960,772

[22] Filed: Nov. 15, 1978

[30] Foreign Application Priority Data

Jun. 14, 1978 [JP] Japan ..... 53-71897
Jun. 16, 1978 [JP] Japan ..... 53-73645

[51] Int. Cl.[3] ..... F04B 1/12; C22C 9/02; C22C 9/10; C22C 9/05

[52] U.S. Cl. ..... 417/269; 75/160; 75/161; 75/163; 75/164; 75/153; 75/154; 148/32; 148/32.5; 308/DIG. 8

[58] Field of Search ..... 75/156, 160, 161, 163, 75/164, 157.5, 154, 153; 308/DIG. 8, DIG. 9; 417/269; 428/645; 91/472; 148/32, 32.5

[56] References Cited

U.S. PATENT DOCUMENTS 1,614,878 1/1927 Cochrane ..... 75/156.5
2,721,519 10/1955 Henrichsen ..... 91/472 X
3,156,589 11/1964 Klement ..... 75/154 X
3,999,893 12/1976 Kishi ..... 417/269
4,037,522 7/1977 Inoshita et al. ..... 308/DIG. 8 X

FOREIGN PATENT DOCUMENTS 515808 8/1955 Canada ..... 428/645
1187805 2/1965 Fed. Rep. of Germany ..... 428/645
51-2414 1/1976 Japan ..... 75/157.5

*Primary Examiner*—Donald R. Valentine
*Attorney, Agent, or Firm*—Burgess, Ryan and Wayne

[57] ABSTRACT

Shoes for operatively connecting a swash-plate with the compression pistons of a swash-plate type compressor are made from a novel Cu-based alloy. Improved shoes are characterized by a combination of high heat conductivity and excellent wear resistance properties particularly when subjected to a lubricating condition so severe that no lubricating oil is supplied to the surface of the shoes at the initial period of the compressor operation. At least three alloying elements are selected from Mn, Si, Pb, Sn, the IVb and VIb groups of the periodic table, and added in predetermined amounts to the Cu-based alloy, so that the properties mentioned above are simultaneously obtained. The compressor according to the present invention can be reliably employed, without the occurrence of seizure over a long operational period for air-conditioning vehicles, in which the sliding condition of the shoes is drastically varied with the rotation of the engine.

30 Claims, 11 Drawing Figures

SWASH-PLATE-TYPE COMPRESSOR FOR AIR-CONDITIONING VEHICLES

The present invention relates to a compressor, and particularly to a swash-plate type compressor for air-conditioning vehicles.

U.S. Pat. No. 3,955,899 issued to Nakayama et al discloses a swash-plate type compressor, in which the swash plate is secured to and rotated with a drive shaft, the rotating movement of which shaft is converted to a reciprocal movement via shoes slidably engaged with the swash plate and via ball bearings for slidably pressing the shoes against the swash plate. The swash-plate type compressor disclosed in the patent mentioned above eliminates the necessity of an oil pump for lubricating the movable parts of the compressor, because, according to the recent tendency to decrease the weight of the vehicle, all compressors utilized for air-conditioning vehicles are required to have a compact structure and a light weight. A small amount of lubricating oil supplied to the slidable arrangements, for example, between the shoes and the ball bearings of the swash-plate type compressor disclosed in the U.S. patent mentioned above, is supplied in a gaseous state after being mixed with a refrigerant gas. The lubricating system employed in the swash-plate type compressor, without the presence of an oil pump, gasifies the lubricating oil and effectively circulates the oil through the slidable arrangements of the compressor.

Materials such as (A) alloy steels for structural uses, for example, (1) nickel-chromium steel, (2) nickel-chromium-molybdenum steel and (3) chromium-molybdenum steel, and (B) a nodular graphite cast iron have heretofore been used for forming a swash plate so as to provide the swash plate with mechanical rigidity, fatigue strength and wear resistance. In such cases, the surface of the swash plate was quenched so as to enhance the wear resistance and the fatigue strength thereof. Since the ball bearings must mainly undertake a high load, a high-carbon chromium steel and the like were used for constructing the ball bearings. With regard to the shoes, materials such as Alusil alloy, phosphorus bronze, copper-lead-tin alloy, brass, high strength brass alloy, bronze alloy, aluminum bronze, Babbitt metal and oil-impregnated bearing alloy were considered in the art to be suitable materials for constructing the shoes.

However, when the swash-plate type compressor is employed for air-conditioning vehicles, the operational conditions of the compressor become considerably more severe, because the drive source of the compressor is an internal combustion engine, i.e., a gasoline engine or a Diesel engine, and furthermore because the compressor, which is compact in structure and light in weight, is rotated at almost the same rotational speed as that of the internal combustion engine. Accordingly, the swash-plate type compressor is subjected to a rotational rate of 500 rpm when the internal combustion engine is idling, and to a rotational rate of 6000 rpm during sudden acceleration or during high speed travel.

In addition, frictional wear of the sliding elements of the compressor is liable to be induced because the oil pump mentioned above is eliminated from the compressor and also because the amount of the lubricating oil used therein is decreased for increasing the efficiency of the compressor mentioned above. In more detail, the service life of the slidable arrangement between the swash plate and the shoes is most critically influenced by the lubricating condition therebetween, particularly by the amount of lubricating oil. In addition, since the sliding movement of the swash plate with respect to the shoes is performed under thrust sliding, the sliding surfaces are constantly maintained under a boundary lubrication and are thus brought into contact with one another in a solid contact, i.e., without using lubricating oil as an intermediary. It is, therefore, difficult to obtain a sufficient lubricating effect for the slidable arrangement between the swash plate and the shoes, even when the entire amount of lubricating oil supplied to the compressor is increased. In addition to the thrust sliding action, the lubricating oil cannot be supplied to the sliding surfaces of the swash plate and the shoes, because the unsteady rotating movement of the swash-plate compressor is unpreventable as long as the compressor is employed for air-conditioning vehicles. Namely, during a period of several tens of seconds or even a period of a few minutes, after the starting of the compressor, the swash plate slides with respect to the shoes, but it is not lubricated at all by oil; consequently, a solid contact between the shoes and the swash plate is disadvantageously carried out during the initial period of the compressor operation. Accordingly, a detrimental sliding condition which is provided with no lubricating oil supply will in turn cause the occurrence of seizure of the swash plate by the shoes, which seizure is most frequently encountered during accidents in the operation of the swash-plate type compressor. Even if such seizure is not brought about directly by the sliding condition wherein lubricating oil is not supplied, abrasion caused under the above-mentioned detrimental condition may become a serious defect which afterwards leads to the occurrence of seizure of the swash-plate by the shoes. In addition, due to recent temperature increases in engine rooms caused by the addition thereinto of various parts of vehicles, such as devices for purification of exhaust gas for decreasing fuel consumption and the like, lubricating oil used in engine rooms is thus disadvantageously influenced to an appreciable extent by such elevated temperatures.

Since some of the present Inventors found that none of the above-mentioned materials, such as Alusil alloy, was satisfactory for forming shoes to be used under severe, operational conditions of swash-plate type compressors, the Applicant, to whom the invention of the present Inventors was assigned, filed Japanese Patent Application No. 49-109,865 for the present invention, in which only a bimetal consisting of a steel base and an alloy powder of copper-lead-tin sintered onto the base is disclosed as an applicable material for ensuring the long service life of the shoes. However, it has now been discovered by the present Inventors that this bimetal is not sufficiently suited for the swash-plate type compressor, which is required to be smaller in size and more effective than before, because seizure of the swash plate by the shoes occurs quite visibly in this compressor.

It is, therefore, the main object of the present invention to provide a swash-plate type compressor, which possesses a higher degree of efficiency and a longer service life than the conventional compressors.

It is another object of the present invention to provide shoes for the swash-plate type compressor which are particularly adapted to the air-conditioning vehicles, so that such shoes can withstand the alternating sliding and thrust pressures and also resist effectively under sliding conditions wherein a minor amount of lubricating oil is circulated in the state of a gaseous mixture with the refrigerant gas within the compressor and wherein a minor amount of lubricating mixture is not supplied at all to the sliding arrangement of the shoes and the swash plate during a period of a few seconds or even a few minutes after the starting of the compressor.

In accordance with the objects of the present invention, there is provided a swash-plate type compressor, comprising a cylinder block, a swash-plate rotatably mounted in the cylinder block and supported by a rotating drive shaft, at least one piston slidably retained within the cylinder block, and shoes mounted on the swash plate and retained by ball bearings, which ball bearings are operably connected with the piston, wherein the swash-plate reciprocates, by its rotation, at least one piston via the shoes and ball bearings, characterized in that the shoes consist of a copper-based alloy containing from 0.5 to 8% of manganese, from 0.1 to 4% of silicon, and from 0.5 to 15% of lead. This copper alloy is hereinafter referred to as an A group alloy with Pb.

In accordance with the present invention, the copper-based alloy used for the shoes of the swash-plate type compressors mentioned above can be of any one of the following compositions.

A. A copper-based alloy, which is hereinafter referred to as as A group alloy with Pb and Sn, consists essentially of from 0.5 to 8% of manganese, from 0.1 to 4% of silicon, from 0.5 to 15% of lead and less than 5% (not including zero%) of tin, the balance being copper.

B. A copper-based alloy, which is hereinafter referred to as an A group alloy with Sn, consists essentially of from 0.5 to 8% of manganese, from 0.1 to 4% of silicon and less than 5% (not including zero%) of tin, the balance being copper.

C. A copper-based alloy which is hereinafter referred to as the basic A-B group alloy, consists essentially of from 0.5 to 8% of manganese, from 0.1 to 4% of silicon, and not more than 1% in total of at least one element selected from the IVb group and the VIb group of the periodic table, the balance being copper.

D. A copper-based alloy, which is hereinafter referred to as the A-B group alloy with Pb, consists essentially of from 0.5 to 8% of manganese, from 0.1 to 4% of silicon, not more than 1% in total of at least one element selected from the IVb group and the VIb group of the periodic table, and from 0.5 to 15% of lead, the balance being copper.

E. A copper-based alloy, which is hereinafter referred to as the A-B group alloy with Sn, consists essentially of from 0.5 to 8% of manganese, from 0.1 to 4% of silicon, not more than 1% in total of at least one element selected from the IVb group and the VIb group of the periodic table and less than 5% (not including zero%) of tin, the balance being copper.

F. A copper-based alloy, which is hereinafter referred to as the A-B group alloy with Pb and Sn, consists essentially of from 0.5 to 8% of manganese, from 0.1 to 4% of silicon, not more than 1% in total of at least one element selected from the IVb group and the VIb group of the periodic table, from 0.5 to 15% of lead, and less than 5% (not including zero%) of tin, the balance being copper.

G. A copper-based alloy, which is hereinafter referred to as the C group alloy with Sn, consists essentially of not more than 3% in total of at least one element selected from the IVb group and the VIb group of the periodic table, and less than 5% (not including zero%) of tin, the balance being copper.

H. A copper-based alloy, which is hereinafter referred to as the C group alloy with Pb, consists essentially of not more than 3% in total of at least one element selected from the IVb group and the VIb group of the periodic table, and from 0.5 to 15% of lead, the balance being copper.

I. A copper-based alloy, which is hereinafter referred to as the C group alloy with Pb and Sn, consists essentially of not more than 3% in total of at least one element selected from the IVb group and the VIb group of the periodic table, from 0.5 to 15% of lead and less than 5% (not including zero%) of tin, the balance being copper.

The percentages used in the specification are all by weight.

The preferable compositions of the copper based alloys according to the present invention are as follows.

A group alloy with Pb consists essentially of from 1 to 5% of manganese, from 0.3 to 2% of silicon, and from 2.5 to 10% of lead.

A'. A group alloy with Pb and Sn consists essentially of from 1 to 5% of manganese, from 0.3 to 2% of silicon, from 2.5 to 10% of lead and from 1 to 3% of tin, the balance being copper.

B'. A group apply with Sn, consists essentially of from 1 to 5% of manganese, from 0.3 to 2% of silicon and from 1 to 3% (not including zero%) of tin, the balance being copper.

C'. The basic A-B group alloy, consists essentially of from 1 to 5% of manganese, from 0.3 to 2% of silicon, and from 0.2 to 0.8% in total of at least one element selected from the IVb group and the VIb group of the periodic table, the balance being copper.

D'. The A-B group alloy with Pb, consists essentially of from 1 to 5% of manganese, from 0.3 to 2% of silicon, from 0.2 to 0.8% in total of at least one element selected from the IVb group and the VIb group of the periodic table, and from 2.5 to 10% of lead, the balance being copper.

E'. The A-B group alloy with Sn, consists essentially of from 1 to 5% of manganese, from 0.3 to 2% of silicon, from 0.2 to 0.8% in total of at least one element selected from the IVb group and the VIb group of the periodic table and from 1 to 3% and of tin, the balance being copper.

F'. The A-B group alloy with Pb and Sn, consists essentially of from 1 to 5% of manganese, from 0.3 to 2% of silicon, from 0.2 to 0.8% in total of at least one element selected from the IVb group and the VIb group of the periodic table, from 2.5 to 10% of lead, and from 1 to 3% of tin, the balance being copper.

G'. The C group alloy with Sn, consists essentially of from 0.3 to 2% in total of at least one element selected from the IVb group and VIb group of the periodic table, and from 1 to 3% of tin, the balance being copper.

H'. The C group alloy with Pb, consists essentially of from 0.3 to 2% in total of at least one element selected from the IVb group and the VIb group of the periodic table, and from 2.5 to 10% of lead, the balance being copper.

I'. The C group alloy with Pb and Sn, consists essentially of from 0.3 to 2% in total of at least one element selected from the IVb group and the VIb group of the periodic table, from 2.5 to 10% of lead and from 1 to 3% of tin, the balance being copper.

There is no authentic designation in the chemical field for the A and B subgroups of the III, IV, V, VI and VII groups of the periodic table. The IVb and Vb subgroups used herein correspond to the designation, which is recited on page 277 of Concise Encyclopaedic Dictionary of METALLURGY (edited by D. Birchon and published by Elsevier), and which is adopted by Sinnott. The Solid State for Engineers (John Wiley and Sons, Inc., New York, 1958) and Richards, Engineering Material Science (Wadsworth Publishing Co., Inc., San Francisco; Chapman and Hall, London, 1961). The IVb subgroup defined in the above-mentioned dictionary includes titanium, zirconium and hafnium, and the VIb subgroup includes chromium, molybdenum and tungsten.

In the present invention the copper-based alloy is strengthened to suppress the reduction of hardness at an elevated temperature as long as heat conductivity which is usually deteriorated by an alloying element is not reduced appreciably. As a result, shoes with an excellent sliding characteristic are obtained. The alloying elements according to the present invention can strengthen the copper-based alloy, while these elements do not essentially bring about harmful effects such as (1) the Cu matrix of the alloy being excessively hardened and embrittled with an increase of the elements in a solid solution, (2) the occurrence of non-uniform precipitation of intermetallic compounds in the Cu matrix, and (3) heat conductivity of the alloy being undesirably reduced.

The Inventors carried out metallographic examination of the alloys according to the present invention and were thus able to clarify the typical structure of the alloys. The compositions of the alloying elements are explained in detail in connection with the metallographic structure of the alloys. The effects of the alloying elements on the properties required for the shoes of the swash-plate type compressor are understood to be as follows, based on the study of metallographic structure mentioned above and the life tests of the shoes installed in the actual compressor.

In the A group alloys (i.e., the A group alloy with Pb and the alloys mentioned in items A and B, above) and the A-B group alloys (i.e., the alloys mentioned in items C through F, above), the manganese and silicon are present in the alloys mainly as a solid solution of the alloys and the mechanical strength of the alloys is enhanced due to the solid solution hardening. The simultaneous addition of manganese and silicon to the copper-based alloys, however, leads to the formation of the Mn-Si compounds and the precipitation of a part of the manganese and silicon in the Cu matrix. Accordingly, an effective strengthening of the A group alloys and the A-B group alloys is promoted by both the solid-solution and the precipitation effects of manganese and silicon, and the wear resistance is improved in addition to the strengthening of the alloys. The content of silicon in the A and A-B group alloys should be from 0.1 to 4%, preferably from 0.3 to 2.0%, because an Si content of less than 0.1% is insufficient for causing the matrix of the alloys to be hardened by the solid solution of Si, while an Si content in excess of 4% may lead to the excessive precipitation of intermetallic compounds and thus embrittlement of the alloys. The content of manganese in the A and A-B group alloys should be from 0.5 to 8%, preferably from 1 to 5%, and more preferably from 4 to 5%. The mechanical properties of the alloys can be enhanced by the addition of manganese alone due to the solid solution of manganese in the Cu matrix. However, when both manganese and silicon are added to the A and A-B group alloys, desirable eutectic Mn-silicides can be formed in the alloys and can also provide the alloys with excellent wear resistance. When, however, the Mn addition content is less than 1%, hypoeutectic silicides are formed and hence excellent wear resistance cannot be obtained. On the other hand, when the Mn addition content exceeds 8%, the hardness of the Cu matrix is so high that shoes made from the alloys mentioned above wear out the mating material. At the same time, heat conductivity of these alloys is excessively reduced.

The lead, which is added to the A group alloy with Pb, the A group alloy with Pb and Sn, and the A-B group alloy with Pb or with both Pb and Sn is an element of a low melting point (less than 400° C.) and is not present as a solid solution but is dispersed in the Cu matrix. The addition of lead considerably enhances the sliding characteristics of the shoes with respect to the swash-plate. Namely, the soft Pb phases dispersed in the alloys mentioned above are readily deformed by the minute unevenness of the swash-plate surface, and also produce a surface upon which the swash-plate can smoothly slide. The lead addition, therefore, enhances the adaptability of the shoes to the swash-plate surface condition (hereinafter referred to as the break-in property) and to the smooth sliding motion of the swash plate. Accordingly, due to the lead addition, it is possible to more effectively mitigate the troublesome effects caused by the condition wherein lubricating oil is not present at the slidable engagement between the shoes and the swash plate during the initial operating period of the swash-plate type compressor than in the case of the Mn- and Si- addition only. The content of lead should be from 0.5 to 15% because a lead content of less than 0.5% is too low to obtain the above-mentioned break-in property. Furthermore, if the lead content exceeds 15%, it is difficult to distribute the lead uniformly in the copper-based alloy unless a special process for producing the copper-based alloy is used alloys. Moreover, a Pb content exceeding 15% will disadvantageously reduce the strength of the Cu matrix.

At least one element selected from the IVb group and the VIb group of the periodic table is mainly precipitated in the Cu matrix for strengthening the A-B group alloys mentioned in items C through F, above, while the manganese and silicon contents of these alloys are mainly present as a solid solution of the Cu matrix. In the A-B group alloys, the A group elements, (i.e., manganese and silicon) and the B group element(s) (i.e., element(s) selected from the IVb group and VIb group) are combined together for effectively hardening the copper-based alloys and for effectively improving the wear resistance of the alloys. In the IVb and VIb groups of the periodic table, titanium, zirconium, chromium, molybdenum and tungsten are usually used alone or in combination, and chromium, titanium and zirconium can be effectively used alone or in combination. The chromium induces the precipitation hardening of the A-B group alloys and thus increases the strength of the A-B group alloys. However, since these alloys are embrittled as a whole by an excessive amount of the chromium addition, the appropriate chromium content should not exceed 1%, i.e. the level at which the precipitation hardening of the A-B group alloys takes place. The titanium precipitates in the matrix of the A-B group alloys after heat treatment and also increases the hardness of the A-B group alloys. The appropriate titanium content to be added to the A-B group alloys is in an amount of 1% or less. Zirconium forms intermetallic compounds with several components of the A-B group alloys and thereby strengthen these A-B group alloys. Such strengthening of alloys by adding the above-mentioned elements in combination to form intermetallic compounds is more effective than strengthening of alloys by adding such elements separately to form the intermetallic compounds, even when the content of the separate amount of element is equal to the content of the total amount of added elements.

When the Zr content exceeds 1%, heat conductivity of the copper-based alloy is abruptly reduced; accordingly; the Zr content should therefore be adjusted properly to an amount not exceeding 1%.

In the case where two or more elements selected from the IVb group and the VIb group of the periodic table are used, the total amount of such elements should not exceed 1% because embrittlement of the entire copper-based alloy is induced if the total amount of the elements used exceeds 1%. The mininum content of the IVb and VIb group element(s) should be approximately 0.1% (in total) for both cases of the single addition and the combined addition of such elements. A minor amount of the IVb and VIb group element(s) is effective for improving the mechanical strength of the A-B group alloys. Therefore, the minimum content mentioned above is not absolutely crucial but preferable for obtaining a sufficient mechanical strength. When at least two elements of the IVb and VIb groups are used, their contents may be either the same or different. In the case where two elements are used, the minimum content of one element is approximately 0.05%; in the case where three elements are used, the minimum content of one element is approximately 0.03%.

In the C group alloys, no manganese or silicon is added thereto; however, at least one element selected from the IVb group and the VIb group of the periodic table is added thereto in a total amount of 3%, which amount is considered to be rather high. In other words, the advantageous effects of adding this element to the C group alloys, which effects are similar to those explained above in connection with the A-B group alloys, are maintained if the added amount does not exceed 3%, and undesirable effects such as embrittlement will appear if the total added amount exceeds 3%. The preferable total content of at least one element selected from the IVb and VIb groups of the periodic table to be added into the C group alloys is from 0.3 to 2%. The elements of IVb and VIb groups are distributed in the Cu matrix mainly by precipitation or cristallization processes. These elements harden the Cu matrix, supress the reduction of the hardness of alloy at an elevated temperature higher than 200° C. and improve the wear resistance of the alloys. The various kinds, behaviors and minimum content, of the IVb group and the VIb group are basically identical to those already explained in connection with the A-B group alloys, and therefore are not explained again in detail to avoid repepition.

Tin, which is added into the A group alloys with Pb and Sn, A group alloys with Sn, A-B group alloys with Sn, A-B group alloys with Pb and Sn, the basic C group alloys and the C group alloys with Pb and Sn, is present as solid solution of the Cu matrix to harden the matrix. As a result of experiments, the tin was found to decrease and to advantageously stabilize the coefficient of friction even at elevated temperatures. The sliding engagement between the shoes and the swash plate was also found to exhibit an excellent resistance against seizure, particularly at elevated temperatures. Tin, which is present as a solution of the Cu matrix as stated above, is therefore liable to reduce heat conductivity of the copper-based alloy. Consequently, the maximum, Sn content should be 5%. The preferable Sn content is from 1 to 3%. Tin has also been found to improve the castability of the copper-based alloy. With respect to the A group alloys and the A-B group alloys, alloys containing lead or containing both lead and tin are preferable as materials for producing shoes which can be mounted in the highly-efficient swash-plate type compressor for air-conditioning vehicles using a small amount of the lubricating oil. Fractors which are most critical to such swash-plate type compressor are heat conductivity of the shoes and the level of the coefficient of friction. A high coefficient of friction is a direct cause of heat generation on the surface of contact between the swash plate and the shoes, and furthermore, the major factors affecting the above-mentioned heat conductivity are the type and the amount of alloying elements. Accordingly, in order to mount the shoes in the highly efficient, swash-plate type compressor, the hardening and excellent break-in properties of the Cu matrix must be attained by maintaining the contents of the alloying elements to a level which is as low as possible. In more detail, both of these properties of the Cu matrix are required particularly during the initial operation of the swash-plate type compressor. During the normal operation period, since a relatively small and insufficient lubricating oil is supplied to the shoes, the sliding characteristics of the shoes are enhanced not by the improved break-in property of the Cu matrix but mainly by the increased heat conductivity of the shoes, thereby heat is effectively radiated from the shoes and furthermore, reduction of the hardness of shoes at an elevated temperature, due to the structure change of the shoes, is suppressed.

As mentioned hereinbefore, tin, manganese and silicon contribute mainly to enhancing the sliding characteristics during the normal period of operation. On the other hand, the enhanced break-in property attained by the lead addition to the copper-based alloy is not highly effective during the normal operation period but only during the initial operation period of the swash-plate type compressor. During this initial period, hardly any lubricating oil is present between the swash plate and the shoes. The above-mentioned sliding condition may be mitigated during the initial operation period so that the oil-free lubricating condition is caused to disappear within a short period of time due to the design of the swash-plate type compressor. However, this condition cannot be caused to disappear completely. Moreover, this condition may sometimes occur even during the normal operation period, because the lubricating oil and the refrigerant gas may sometimes be decreased during this period. The shoes made of alloys containing Pb and Sn can therefore be used under various sliding conditions wherein no seizure is caused to occur between the shoes and the swash plate.

All kinds of copper-based alloys according to the present invention explained hereinabove possess (1) the property of heat conductivity required for producing a highly efficient, swash-plate type compressor for air-conditioning vehicles, i.e. preferably 0.2 cal/cm$^2$ sec.°C. or more, and more preferably; a heat conductivity of 0.4 cal/cm$^2$ sec.°C., and (2) a Vickers hardness of 80 or higher at a temperature of 300° C. These copper-based alloys may contain a trace amount of nickel, iron, tellurium, antimony or arsenic as impurities or as additional elements. These elements are mainly advantageous for enhancing the strength of the copper-based alloys or for refining the grain size of the matrix of such alloys. However, the advantageous effects of these elements are inferior to those of manganese, silicon, lead and tin. Therefore, the additional elements mentioned above may be present only in a trace amount, if these elements are intentionally added to the alloys of the present invention.

Due to the compositions of the alloys according to the present invention, the following advantages can thereby be obtained. Namely since the content of the alloying elements used in the shoes of the present invention is considerably lower than the content of copper-based alloys used in conventional shoes, the shoes of the present invention have such an excellent heat conductivity, that a great amount of heat due to friction generated at the slidable engagement between the shoes and the swash plate is easily radiated from the shoes, even when this engagement is not substantially lubricated for a long period of time. As a result, the shoes cannot be easily softened due to the heat generated by friction, and seizure of the shoes is thereby prevented from occurring.

From the above-stated fact that the content of alloys according to the present invention is low, it would seem that the alloys according to the present invention would not be strong enough. On the other hand, although conventional, high strength brass and low Si-Mn bronze contain as high as 40% of alloying elements, such brass and bronze still have a poor heat radiation property. However, since the above-mentioned seizure easily occurs in these conventional copper-based alloys due to poor heat radiation thereof, attempts to prevent such seizure have been made by persons skilled in the art by adding large amount of lead into these conventional, copper-based alloys, so as to enhance the break-in property and the sliding property of the alloys. The alloys to which lead has been added have a mechanical strength slightly superior to that of the present invention, in which lead and other alloying elements are low, only at room temperature and not at elevated temperatures. In the alloys of the present invention, only a small amount of lead is used to enhance the break-in property, and the elements present as a solid solution, i.e. manganese, silicon, tin and phosphorus, exhibit a slight reduction in the strength and hardness of the matrix, when the temperature of the shoes is elevated due to friction occurring between the shoes and the swash plate. Therefore, the considerably stable stae of the matrix of the alloys according to the present invention contributes to effectively enhance the break-in property due to the Pb phases which are finely dispersed in this matrix.

The present invention is explained in detail with reference to the drawings, wherein.

Figure 1:
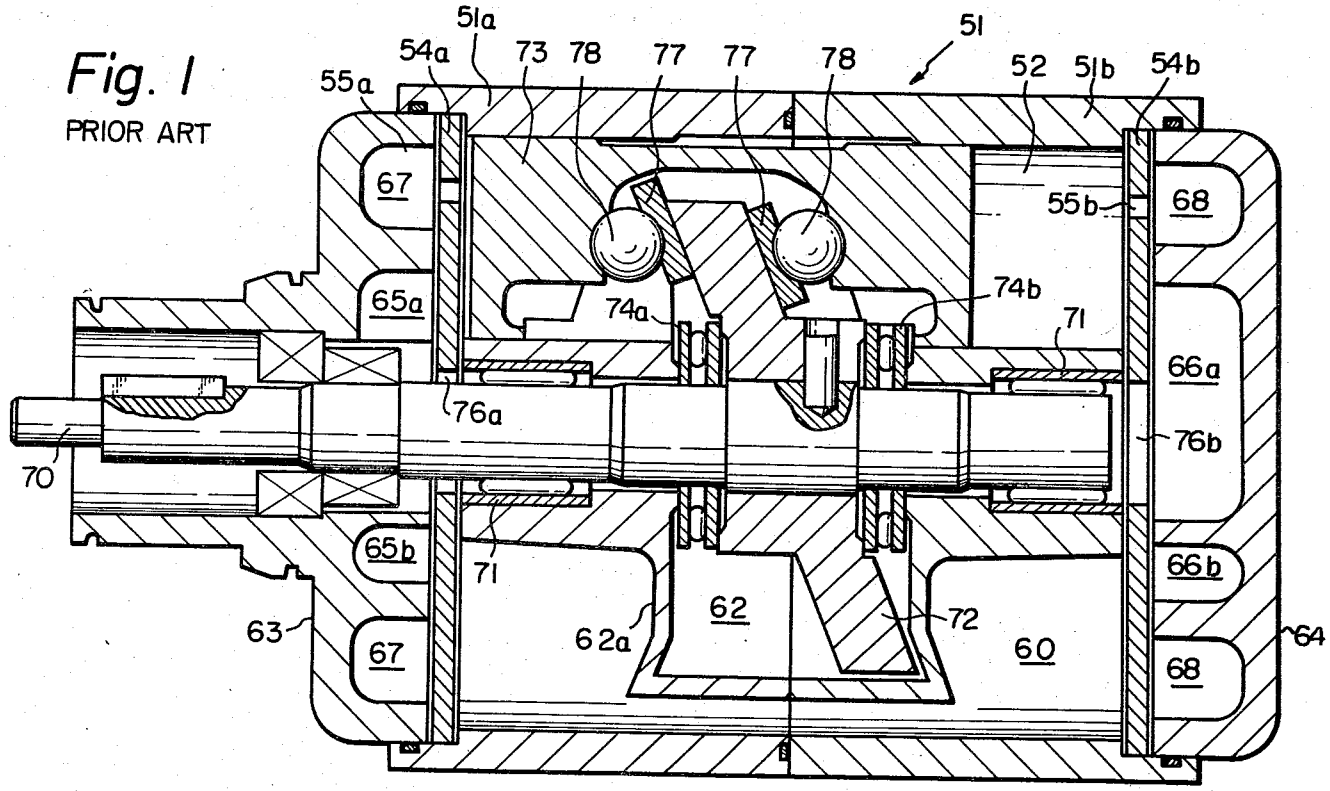
Fig. 1 PRIOR ART
FIG. 1 is a longitudinal cross-sectional view of a swash-plate type compressor according to one embodiment of the present invention.
Figure 2A:
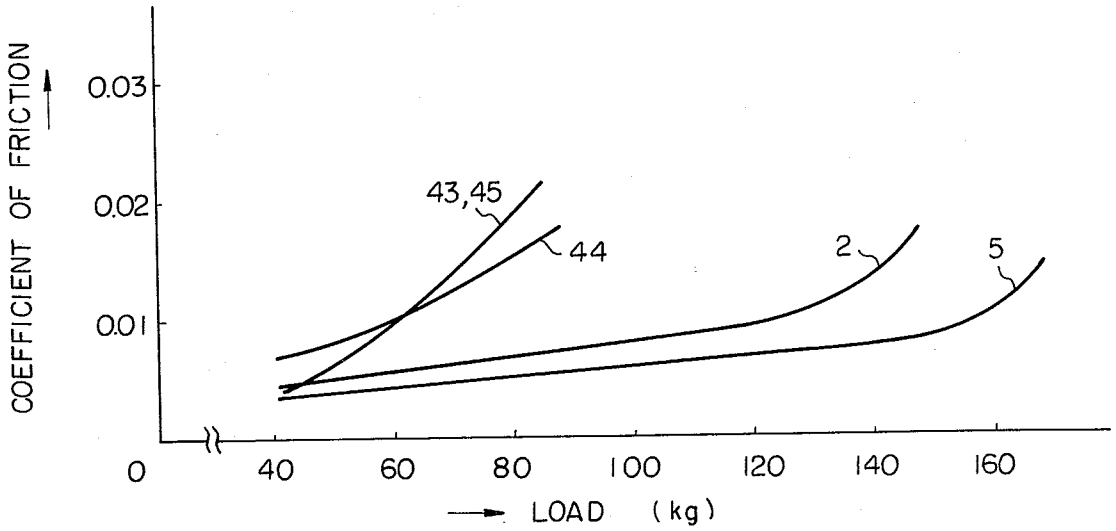
FIGS. 2A through 2E are graphs representing the coefficient of friction obtained in the Example of the present invention.
Figure 2B:
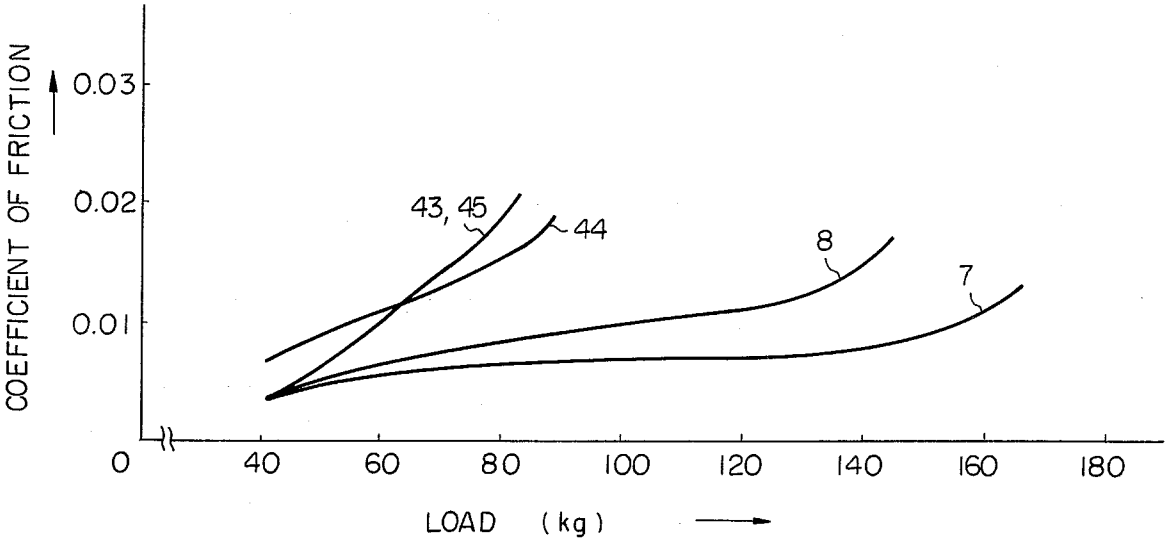
Figure 2C:
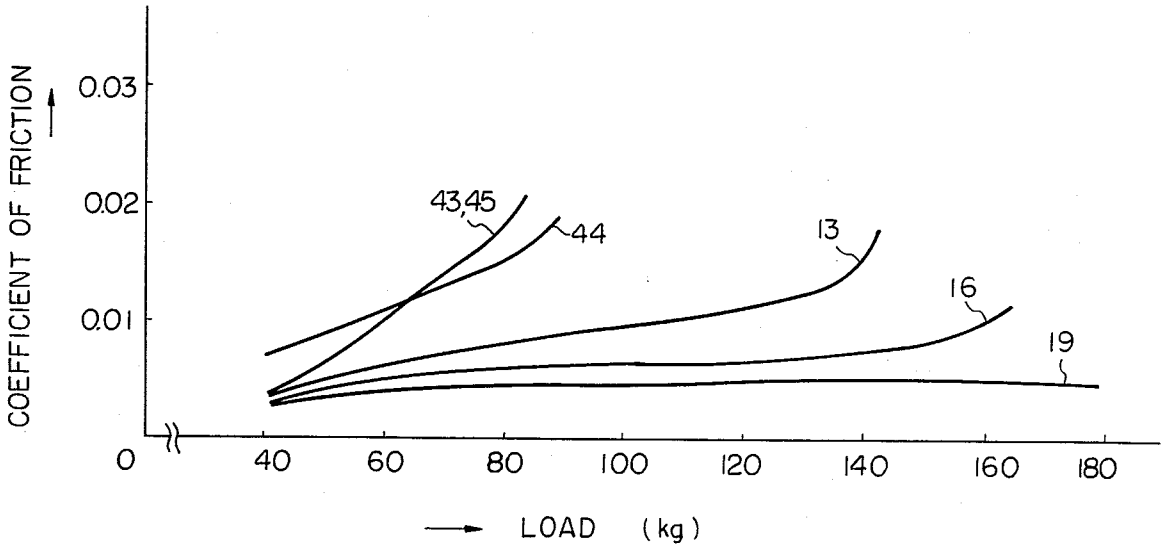
Figure 2D:
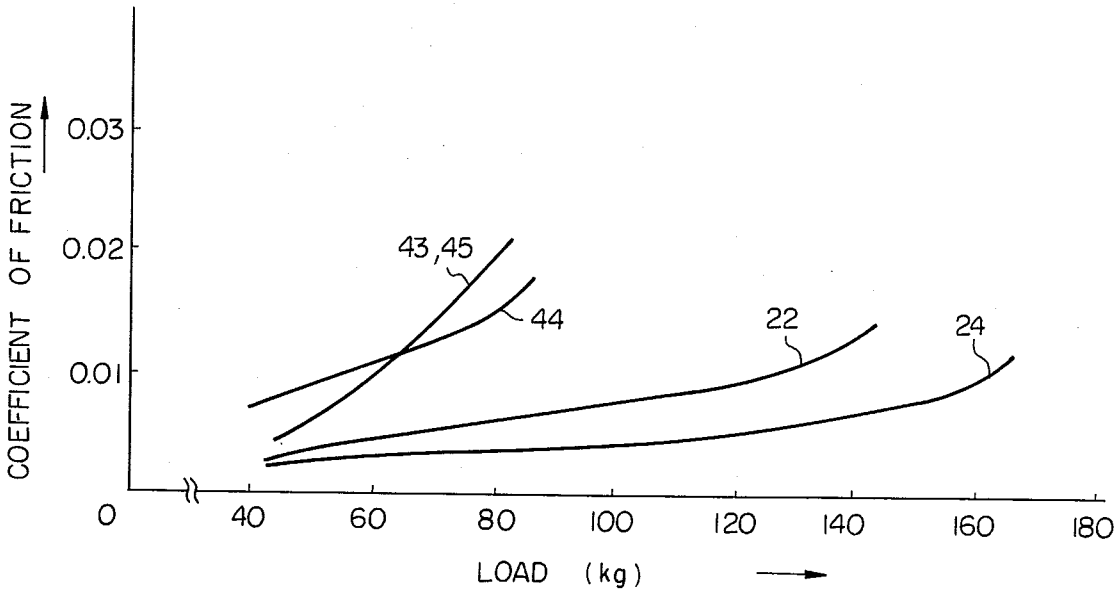
Figure 2E:
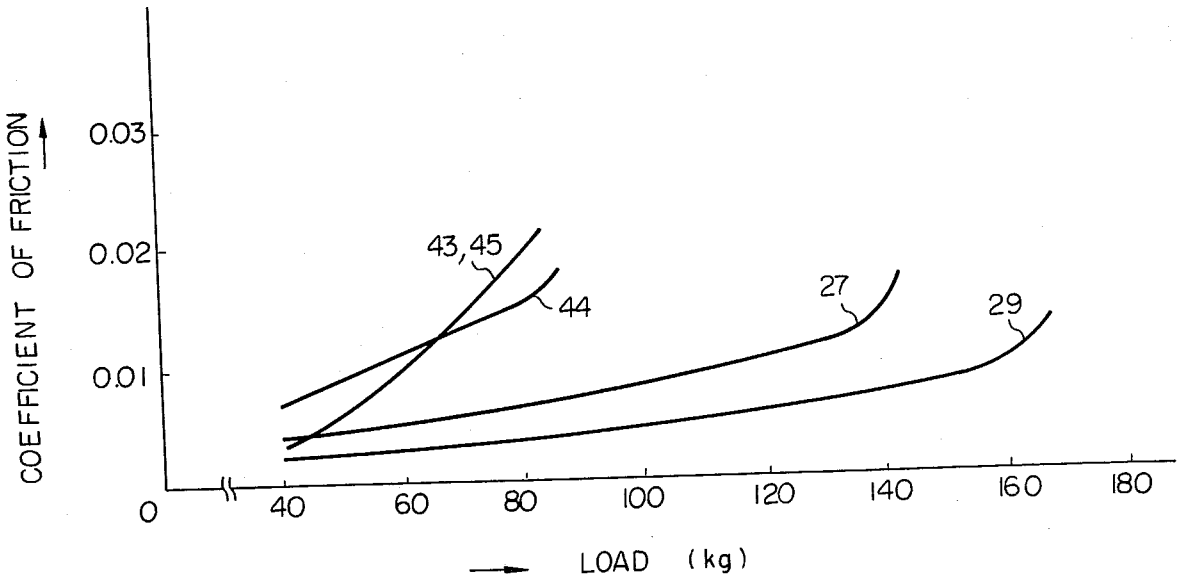
Figure 3A:
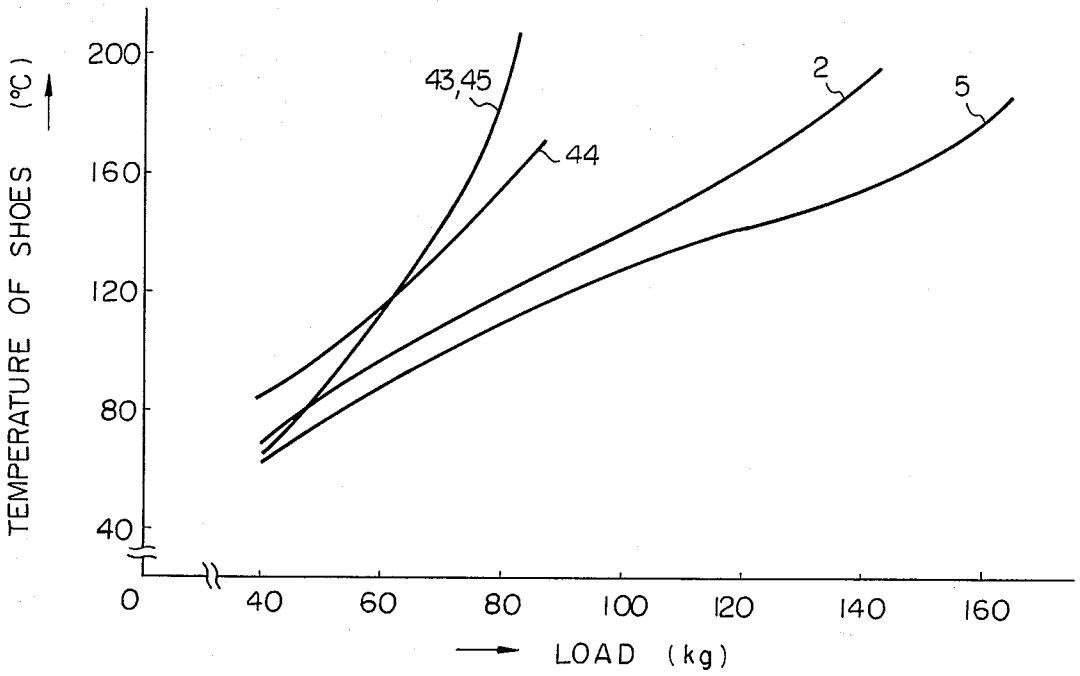
FIGS. 3A through 3E are graphs representing the temperature increase of the shoes obtained in the Example of the present invention.
Figure 3B:
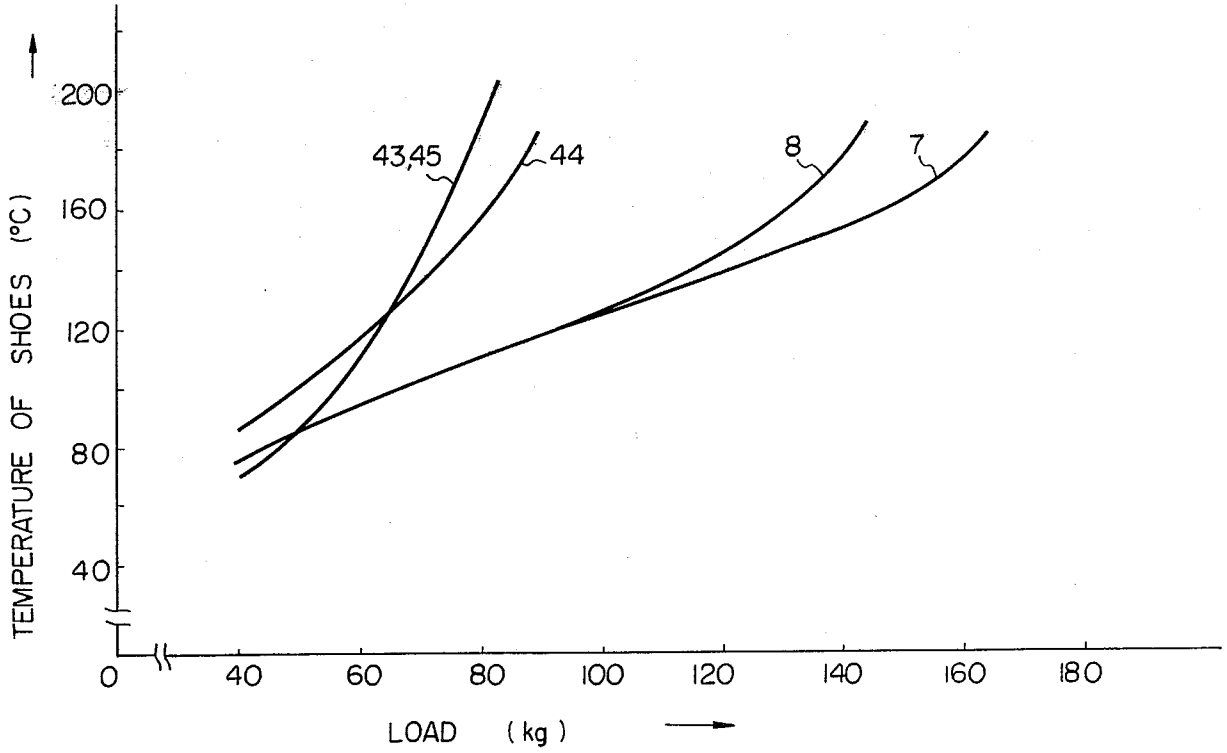
Figure 3C:
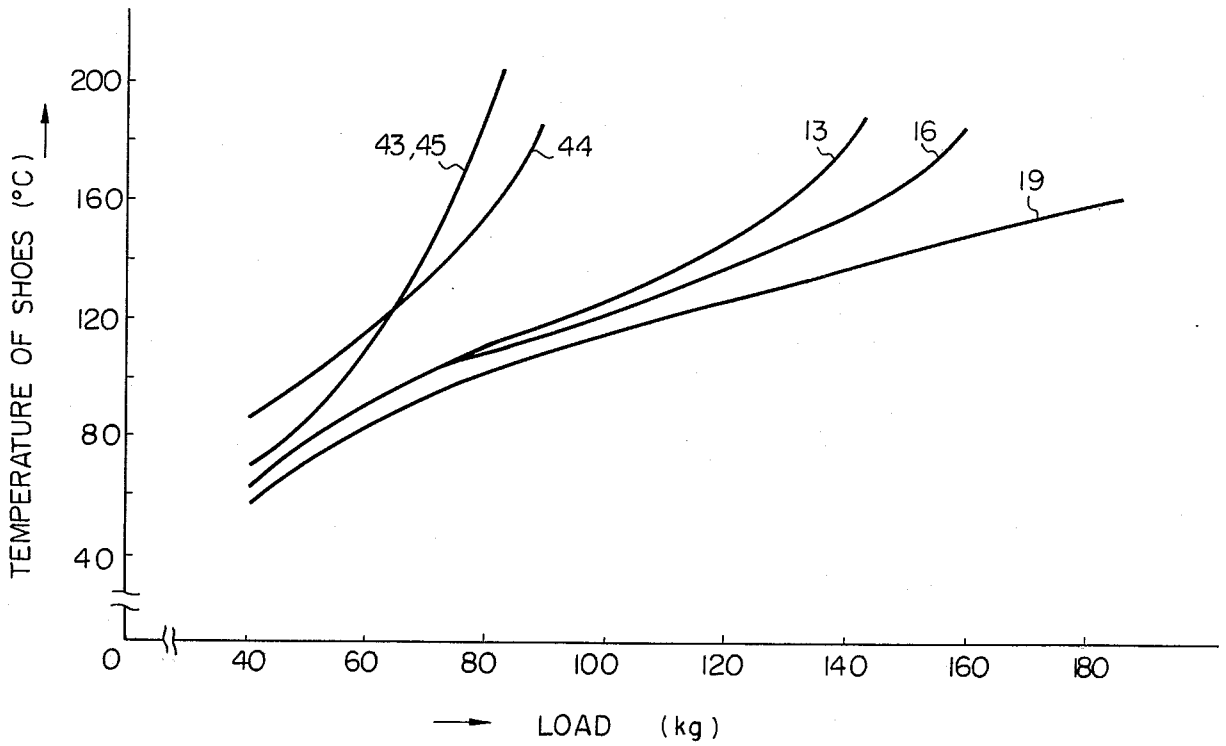
Figure 3D:
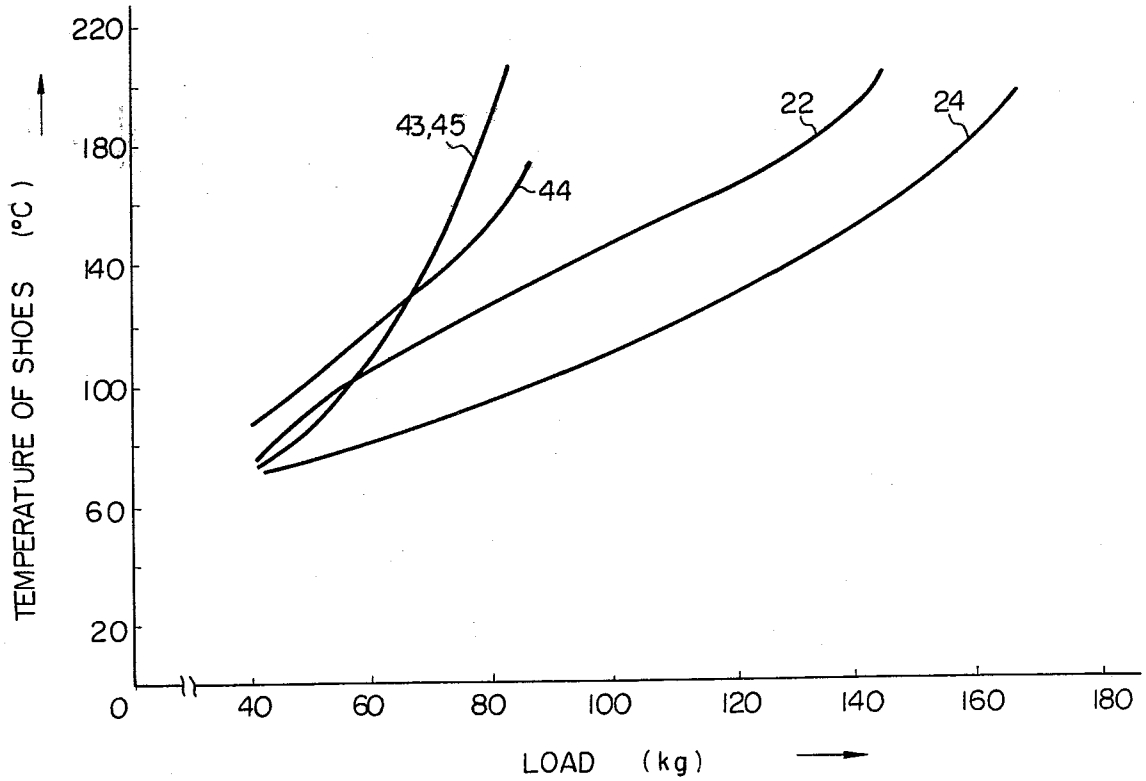
Figure 3E:
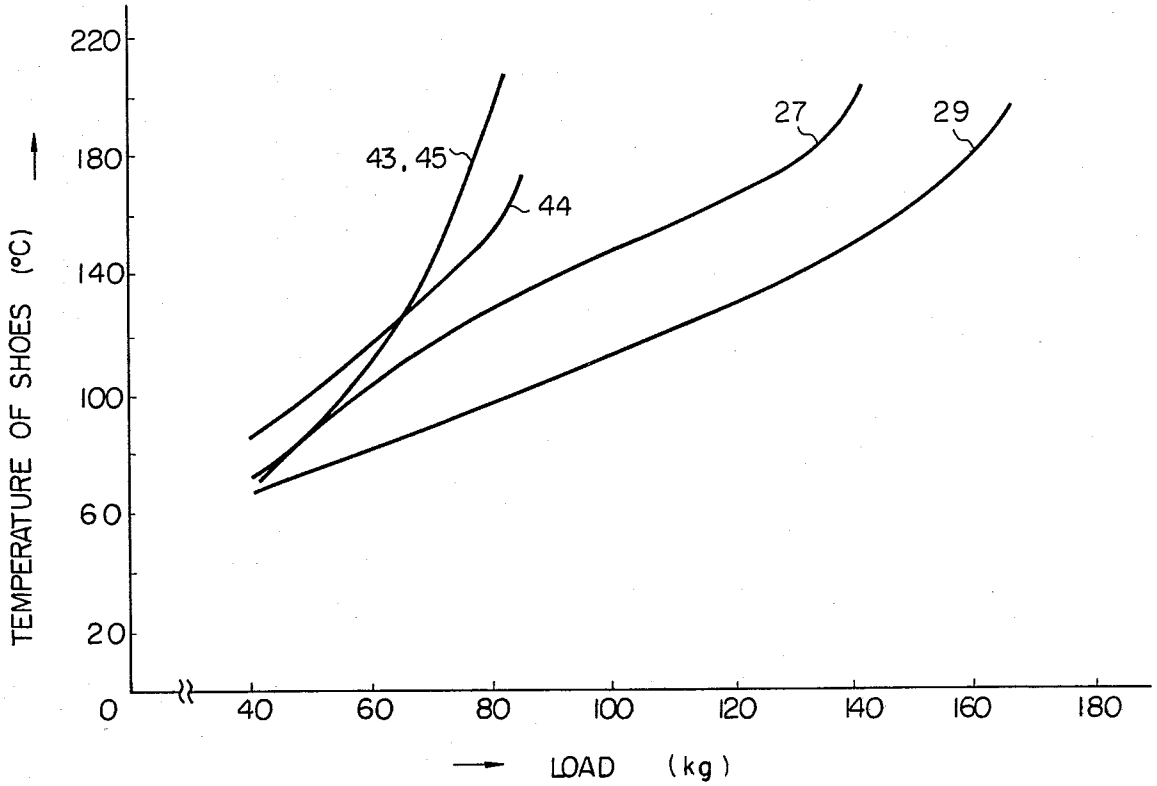

Referring to FIG. 1, the compressor has a pair of cylinder blocks, i.e., a front cylinder block 51*a* and a rear cylinder block 51*b*, combined with each other in an axial alignment. The combined block formed by the pair of cylinder blocks 51*a* and 51*b* is provided with at least one, usually three, axially extending cylinder bores 52 arranged in parallel with each other. The combined block is also provided with a bottom oil reserving section 60, and a centrally arranged swash-plate chamber 62. The combined block is further accompanied by a pair of front and rear cylinder heads 63 and 64 attached to the front and rear cylinder blocks 51*a* and 51*b*, respectively, via respective valve plates 54*a* and 54*b* and appropriate gaskets. The cylinder heads 63 and 64 are provided with, in their internal spaces, suction chambers 65 and 66 and exhaust chambers 67 and 68, respectively. A drive shaft 70 coaxially passes through both cylinder blocks 51*a* and 51*b*, front cylinder head 63, and front valve plate 54*a*. The drive shaft 70 is rotatably supported by needle bearings 71 provided at the axially outer ends of the combined block, and the drive shaft 70 is provided with a swash plate 72 secured to the middle of the drive shaft 70. The swash plate 72 is operatively connected via ball bearings 78 and shoes 77 with double acting multi-pistons 73 which are slidably fitted in the cylinder bores 52 arranged in parallel with the drive shaft 70. Therefore, when the swash plate 72 is rotated by the drive shaft 70, the pistons reciprocate in the cylinder bores for effecting the compression action of the compressor. The axial loads produced by the reciprocating motions of the pistons 73 are borne by a pair of thrust bearings 74*a* and 74*b* arranged between both end faces of the boss of the swash plate 72 and respective cylinder blocks 51*a* and 51*b*. The needle bearings 71 are supplied with oil lubricant through bores 76*a* and 76*b* of the valve plates 54*a* and 54*b*.

The partition walls 62*a* of the swash plate chamber 62 are provided with through-holes (not shown) for permitting a part of the oil particles suspended in the refrigerant gas to directly flow into the swash plate chamber 62. The refrigerant gas is collected in the discharge sections (not shown) of the cylinder blocks 51*a* and 51*b* from the exhaust chambers 67, 68 of both cylinder heads 63 and 64, so as to flow into the air-conditioning system of the vehicle. The partition wall 62*a* is provided with outlet holes (not shown) through which the refrigerant gas and the oil particles in the swash plate chamber 62 can flow into the oil reserving section 60. During the operation of the compressor, the refrigerant gas together with the oil particles suspended in the gas, return from the air-conditioning system of the vehicle and rush into the suction channels (not shown) of cylinder blocks 51*a* and 51*b*. The major part of the refrigerant gas and oil particles then impinge upon the partition wall 62*a* of the swash plate chamber 62. In the meantime, the remaining minor part of the refrigerant gas and the oil particles flows due to inertia into the swash plate chamber 62 through the through-holes (not shown) of the partition walls 62*a*, and the flow of the minor part impinges upon the rotating swash plate 72, so that the oil particles suspended in the refrigerant gas attach to or are splashed by the rotating swash plate.

Elements of the compressor except for the above-mentioned shoes as shown in FIG. 1 basically have the same function and corresponding relationship as those disclosed in U.S. Pat. No. 3,955,899 issued to S. Nakayama, i.e. one of the present Inventors.

In accordance with the present invention, the shoes 77 made of the A group alloys, A-B group alloys or C group alloys and ball bearings 78 operatively connect the swash plate 72 with the pistons 73. As a result, the rotating motion of the drive shaft 70 is converted to the reciprocating motion of the pistons 73. In the bores 52, the reciprocating motion compresses the refrigerant gas which is mixed with oil so as to be circulated in a refrigeration circuit and returned to the compressor, and thereafter transfers the refrigerant gas to the condensor (not shown). The refrigerant gas is cooled in the condensor to be liquefied, and then transferred to the evaporator, thereby the liquefied refrigerant gas is vaporized and the latent heat of vaporization is thus removed from the vicinity of the evaporator. The air in the room whose air is to be conditioned is therefore cooled, while the heat withdrawn from the air is emitted to ambient air during the conduction of the refrigerant gas through the condensor mentioned above.

The shoes 77 according to the present invention can reliably be used under severe sliding condition, in which the swash plate 72 slides with respect to the shoes 77 at a variable speed (V) ranging from approximately 2 to 3 m/sec. during the idling period of the vehicle engine and also at a speed ranging from 20 to 25 m/sec. during maximum rotation, i.e., 6000 rpm of the engine, and even as high as from approximately 7 to 15 m/sec during normal travel. In addition, the shoes according to the present invention can be reliably used for a long period of time under a load as described below. The load is applied to the shoes 78 and thereby causes the piston to compress the refrigerant gas. Such load is varied within a magnitude (P) rauge of from 60 to 130 $kg/cm^2$, or occasionally up to 140 $kg/cm^2$. The product of P and V mentioned above can frequently exceed 2000 but rarely amount to a value corresponding to the product of maximum P and maximum V. The P-V product is varied repeatedly with the change in the number of rotations of the vehicle engine. Because of the P-V product variance, the load applied to the shoes is impact-like particularly at a high engine rotation.

The shoes 77 according to the present invention can be effectively used in the compressor, when the amount of lubricating oil, which is inversely proportional to the refrigerating capacity, is decreased. As a result, a severe lubricating condition is created at the surface between the shoes 77 and the swash plate 72. The shoes 77 according to the present invention are particularly suited for the compressor, which must be operated under a boundary lubrication condition because the swash plate 72 and the shoes 77 are frequently kept in a thrust sliding engagement. This engagement is unavoidable during the initial period of the compressor operation, when, as frequently encountered in vehicle operation, the refrigerant gas is leaked from the conduits of the refrigerant circuit and the amount of refrigerant in the circuit is thus decreased, and also when the amount of refrigerant gas returned to the compressor is decreased by energizing an apparatus fitted on the evaporator for adjusting the vaporizing pressure.

The shoes according to the present invention can be used with a swash plate 72 made from any conventional material.

For an extremely severe sliding condition an alloyed steel such as the chromium steel and the manganese steel should be appropriately selected for the swash plate 72. The nodular graphite cast iron, which exhibits inferior sliding when used against a shoe material other than that of the present invention, can be reliably used in combination with the copper-based alloys of the present invention.

Although an embodiment of the present invention is explained with reference to U.S. Pat. No. 3,955,899, the shoes according to the present invention can also be mounted in the swash-plate type compressor disclosed in U.S. Pat. Nos. 3,750,848 and 3,801,227 issued to Nakayama.

The present invention is explained in further detail by way of the following Example.

EXAMPLE

Alloying elements were added to a copper melt at a temperature of approximately 1250° C. in the sequence of manganese, silicon, tin, chromium, zirconium, titanium and lead. The obtained ingots of copper-based alloy materials were heat-treated at approximately 700° C. for two hours so as to prevent segregation therein. The ingots were each drawn to a round bar of 18 mm in diameter and then cut to a thickness of 4.5 mm. Formed on one side of the discs is a spherical recess with a depth of approximately 3 mm, into which a portion of a steel ball of a diameter of 14 mm is to be engaged.

The chemical compositions of the copper alloy materials are shown in Table I, below.

TABLE I

| Sample No. | Mn (%) | Si (%) | Cr (%) | Zr (%) | Ti (%) | Pb (%) | Sn (%) |
|---|---|---|---|---|---|---|---|
| 1 | 1.0 | 0.5 | — | — | — | 12.0 | — |
| 2 | 3.0 | 1.0 | — | — | — | 5.0 | — |
| 3 | 5.0 | 1.5 | — | — | — | 7.0 | — |
| 4 | 1.0 | 0.5 | — | — | — | 2.0 | 4.0 |
| 5 | 3.0 | 1.0 | — | — | — | 5.0 | 2.0 |
| 6 | 5.0 | 1.5 | — | — | — | 7.0 | 1.0 |
| 7 | 3.0 | 1.0 | — | — | — | — | 2.0 |
| 8 | 1.0 | 0.5 | — | — | — | — | 4.0 |
| 9 | 5.0 | 3.0 | — | — | — | — | 1.0 |
| 10 | 1.0 | 0.7 | 0.5 | — | — | — | — |
| 11 | 3.0 | 1.0 | — | — | 0.5 | — | — |
| 12 | 1.0 | 0.7 | 0.2 | 0.2 | 0.2 | — | — |
| 13 | 1.0 | 0.7 | 0.3 | — | — | 2.0 | — |
| 14 | 3.0 | 1.0 | — | — | 0.5 | 5.0 | — |
| 15 | 3.0 | 1.0 | — | 0.5 | — | 3.0 | — |
| 16 | 1.0 | 0.7 | 0.2 | 0.2 | 0.2 | 5.0 | — |
| 17 | 3.0 | 1.0 | — | — | 0.5 | — | 2.0 |
| 18 | 1.0 | 0.5 | 0.2 | 0.2 | 0.2 | 2.0 | 4 |
| 19 | 3.0 | 1.0 | — | — | 0.5 | 5.0 | 2 |
| 20 | 5.0 | 1.5 | 0.5 | — | — | 7.0 | 1 |
| 21 | — | — | — | — | 0.5 | — | 4.0 |
| 22 | — | — | — | 2.5 | — | — | 3 |
| 23 | — | — | 1.5 | — | — | — | 1 |
| 24 | — | — | 0.5 | — | 0.5 | — | 2 |
| 25 | — | — | 0.5 | 0.5 | 0.5 | — | 2 |
| 26 | | | 1.0 | — | — | 5.0 | — |
| 27 | | | — | — | 3.0 | 5.0 | — |
| 28 | | | 0.2 | 0.5 | 1.0 | 12.0 | — |
| 29 | | | 1.0 | — | — | 8.0 | 3.0 |
| 30 | | | — | — | 3.0 | 2.0 | 1.0 |

In the table, above, the balance of the alloying elements was copper.

For comparison purposes, the discs in the form of shoes were produced from conventional alloy materials as shown in Table II, below, by using the same procedure as that of producing shoes according to the present invention.

TABLE II

| Sample No. | Resignation | Alloy Composition |
|---|---|---|
| 40 | Phosphorus Bronze | Cu-8%Sn-0.4%P |
| 41 | Alusil alloy | Al-20%Si |
| 42 | Babbit metal | Pb-10%Sn-5%Sb-2%Cu |
| 43 | High Strength Brass | Cu-35%Zn-2%Al-1%Si-2.5%Mn-2%Pb |
| 44 | Cu—Pb—Sn sintered alloy | Cu-24%Pb-3.5%Sn |
| 45 | Low Si—Mn bronze | Cu-35%Zn-2%Al-1%Si-2.5%Mn |
| 46 | Al bronze | Cu-8%Al-3%Fe-1%Mn-1%Ni |
| 47 | Pure copper | 100%Cu |

The shoes produced from the alloy samples Nos. 1 through 30 had a hardness more than Hv100 at room temperature.

The heat conductivity of the alloy samples Nos. 1 through 30 and Nos. 40 through 47 is illustrated in Table III, below.

TABLE III

| Sample No. | Heat Conductivity (cal/cm$^2$ sec. °C.) | Sample No. | Heat Conductivity (cal/cm$^2$ sec °C.) |
|---|---|---|---|
| 1 (Invention) | 0.58 | 21 (Invention) | 0.63 |
| 2 (Invention) | 0.65 | 22 (Invention) | 0.64 |
| 3 (Invention) | 0.48 | 23 (Invention) | 0.75 |
| 4 (Invention) | 0.61 | 24 (Invention) | 0.70 |
| 5 (Invention) | 0.65 | 25 (Invention) | 0.68 |
| 6 (Invention) | 0.45 | 26 (Invention) | 0.83 |
| 7 (Invention) | 0.68 | 27 (Invention) | 0.80 |
| 8 (Invention) | 0.63 | 28 (Invention) | 0.64 |
| 9 (Invention) | 0.58 | 29 (Invention) | 0.59 |
| 10 (Invention) | 0.76 | 30 (Invention) | 0.68 |
| 11 (Invention) | 0.68 | | |
| 12 (Invention) | 0.63 | | |
| 13 (Invention) | 0.68 | 40 (Control) | 0.15 |
| 14 (Invention) | 0.66 | 41 (Control) | 0.10 |
| 15 (Invention) | 0.63 | 42 (Control) | 0.15 |
| 16 (Invention) | 0.58 | 43 (Control) | 0.13 |
| 17 (Invention) | 0.65 | 44 (Control) | 0.10 |
| 18 (Invention) | 0.48 | 45 (Control) | 0.17 |
| 19 (Invention) | 0.54 | 46 (Control) | 0.18 |
| 20 (Invention) | 0.44 | 47 (Control) | 0.94 |

The heat conductivity of the copper alloys according to the present invention is superior to that of the alloys Nos. 40 through 46. Roughly speaking, the heat conductivity is higher when the total contents of the alloying elements are low. As can be seen from Table III, Sample No. 23, in which the total content of the alloying elements does not exceed 2.5%, exhibits good heat conductivity.

Experiment 1

Shoes made from the alloy samples shown in Tables I and II were tested to measure the coefficient of friction and heat generation during this measurement. In this test, while each of the shoes was pressed against a rotating disc as the pressure load was gradually increased, the coefficient of friction and the temperature increase of the shoes were measured. The testing conditions used are described as follows.

1. Sliding speed:
   13 m/second (constant)
2. Load:
   increased from 40 Kg/cm$^2$ by 20 Kg/cm$^2$ at every loading stage. The period of each loading stage lasted 30 minutes.
3. Lubricating oil:
   low viscosity oil SSU (Saybolt Universal Second) 70 seconds.
4. Application of lubricating oil:
   the oil was applied by a felt on the disc at a rate of approximately 0.8 cc/minute.
5. Test specimens
   (a) Disc: straightness, 1 μm or less; and surface roughness (maximum), from 0.4 to 0.6-S.
   (b) Shoes: straightness, 1 μm or less, and; surface roughness (maximum), from 0.4 to 0.6-S.

The test results of several alloy samples are shown in FIGS. 2 and 3. The test results of the other alloy samples according to the present invention were slightly inferior to but substantially the same as those shown in FIGS. 2 and 3.

As seen in FIGS. 2(A) through (E), the coefficient of friction according to the alloy samples of the invention is lower than that of the control alloy samples Nos. 43 through 45 for a broad range of load values. With increasing load, the coefficient of friction remains stable, i.e., less than 0.02 at a load of 140 Kg (70 Kg/cm$^2$). In addition, as seen from the temperature increase illustrated in FIGS. 3(A) through (E), the temperature increase of the shoes according to the present invention is lower than that of the control samples over the entire range of load values. From a comparison of the results shown in FIGS. 2 and 3 with those of Table II, the following conclusion can be drawn.

The alloy samples of the present invention exhibit excellent properties because the heat conductivity of the samples exceeds a level of 0.4 cal/cm$^2$ sec °C. Since an increase in load always increases the coefficient of friction of the shoes and thus leads to heat generation on the surface of the shoes, the swash plate is liable to be seized by shoes exhibiting an inferior heat conductivity due to the increase of the friction coefficient and also due to a change in the structure of the shoes. However, the alloy samples of the present invention have an excellent, radiative property of heat generated by the friction mentioned above, so that the temperature of each entire shoe or the temperature of a region of the shoes close to the sliding surface is not elevated to a considerable level. Accordingly, phenomena such as structural changes or increases of the friction coefficient do not substantially occur with regard to the alloy samples of the present invention, and these alloys are therefore stable over a wide range of load values. It is to be noted that mainly because of conditions 1 through 3 of Experiment 1 and also because of condition 4 of Experiment 1, mentioned above, the oil lubrication used in Experiment 1 was not enough. The test results of samples according to the invention, however, were excellent under such conditions.

Experiment 2

Every kind of shoe produced in the above-mentioned Example was tested in the actual compressor under the most severe lubricating conditions. Such test conditions are described as follows.

1. Compressor:

a swash-plate type compressor with a total displacement of 150 cc

2. Number of rotations:
   4000 rpm
3. Gas pressure at the exhaust side:
   Pd=4–5 Kg/cm$^2$
4. Gas pressure at the suction side:
   Ps=approximately −50 mmHg
5. Operation time:
   20 hours
6. Lubricating oil:
   150 cc of an ice machine oil
7. Mating material:
   nodular cast iron
8. Amount of refrigerant gas:
   100 g (approximately 10% of normal amount)

No seizure was found with respect to shoes made from all of the alloy samples Nos. 1 through 30. However, all of the shoes made from alloy samples Nos. 40, 42, 43 and 45 through 47 exhibited seizure, and several pieces of shoes made from alloy samples Nos. 41 and 44 exhibited seizure.

It should be noted that shoes made according to the present invention were found to satisfactorily resist against sliding, which condition is more severe than that occurring during usual operation of the vehicles.

Experiment 3

A service life test under load was performed under the condition wherein inadequate lubrication is likely to occur.

During the service life test, shoes were mounted in the actual compressor. The test conditions are described as follows.

1. Compressor:
   a swash-plate type compressor with a total displacement of 150 cc
2. Number of rotations:
   5500 rpm
3. Gas pressure at the exhaust side:
   Pd=20 Kg/cm$^2$
4. Gas pressure at the suction side:
   Ps=−3 Kg/cm$^2$
5. Operation time:
   400 hours
6. Lubricating oil:
   150 cc of an ice machine oil
7. Operation mode:
   repeating a cycle of 25 seconds of operation and 5 seconds of interruption
8. Mating material:
   a nodular graphite cast iron
9. Amount of refrigerant gas:
   1 Kg The results of the above-described test are shown in Table III, below.

TABLE III

| Sample No. | Amount of Abrasion (mg per one shoe) | Sample No. | Amount of Abrasion (mg per one shoe) |
|---|---|---|---|
| 1 (Invention) | 8 | 21 (Invention) | 10 |
| 2 (Invention) | 7 | 22 (Invention) | 10 |
| 3 (Invention) | 8 | 23 (Invention) | 8 |
| 4 (Invention) | 7 | 24 (Invention) | 7 |
| 5 (Invention) | 5 | 25 (Invention) | 7 |
| 6 (Invention) | 7 | 26 (Invention) | 8 |
| 7 (Invention) | 8 | 27 (Invention) | 9 |
| 8 (Invention) | 10 | 28 (Invention) | 9 |
| 9 (Invention) | 10 | 29 (Invention) | 6 |
| 10 (Invention) | 9 | 30 (Invention) | 7 |

TABLE III-continued

| Sample No. | Amount of Abrasion (mg per one shoe) | Sample No. | Amount of Abrasion (mg per one shoe) |
|---|---|---|---|
| 11 (Invention) | 9 | | |
| 12 (Invention) | 8 | | |
| 13 (Invention) | 7 | 40 (Control) | Seizure |
| 14 (Invention) | 5 | 41 (Control) | Abnormal wear |
| 15 (Invention) | 8 | 42 (Control) | Seizure |
| 16 (Invention) | 6 | 43 (Control) | 40 |
| 17 (Invention) | 7 | 44 (Control) | 20 |
| 18 (Invention) | 5 | 45 (Control) | 42 |
| 19 (Invention) | 3 | 46 (Control) | 60 |
| 20 (Invention) | 6 | 47 (Control) | Seizure |

As is apparent from a comparison of the shoes of Samples Nos. 1 through 30 with those of Nos. 40 through 47, the former shoes produced according to the present invention exhibited no seizure but an amount of abrasion smaller than that of the latter shoes. It has been proved that the shoes produced according to the present invention can effectively resist against sliding, under which condition the lubricating oil is not supplied substantially between the shoes and disc, after the compressor operation is interrupted. The shoes of the present invention can be effectively used without any seizure occurring between the shoes or the disc and swash plate.

What we claim is:

1. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy comprising from 0.5 to 8% of manganese, from 0.3 to 4% of silicon, and from 0.5 to 15% of lead.

2. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which comprises from 0.5 to 8% of manganese, from 0.3 to 4% of silicon, and from 0.1 to 1% in total of at least one element selected from the IVb group and the VIb group of the periodic table, the balance being copper.

3. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which comprises from 0.1 to 3% total of a least one element selected from the IVb group and the VIb group of the periodic table, and less than 5% (not including zero %) of tin, the balance being copper.

4. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which comprises from 0.1 to 3% total of at least one element selected from the IVb group and the VIb group of the periodic table, and from 0.5 to 15% of lead, the balance being copper.

5. A swash-plate type compressor, comprising a cylinder block, a swash plate rotatably mounted in said cylinder block and supported by rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which consists essentially of not more than 3% in total of at least one element selected from the IVb group and the VIb group of the periodic table, less than 5% but more than 0% of tin, and from 0.5 to 15% of lead, the balance being copper.

6. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which consists essentially of from 0.5 to 8% of manganese, from 0.1 to 4% silicon, and from 0.2 to 0.8% of at least one element selected from the IVb group and the VIb group of the periodic table, the balance being copper.

7. A swash-plate type compressor according to claim 2, wherein said copper-based alloy further comprises from 0.5 to 15% of lead.

8. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which consists essentially of 0.3 to 2% of at least one element selected from the IVb group and the VIb group of the periodic table, and less than 5% more than zero % of tin, the balance being copper.

9. A swash-plate type compressor, comprising a cylinder block, a swash plate rotatably mounted in said cylinder block and supported by rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which consists essentially of 0.3 to 2% of at least one element selected from the IVb group and the VIb group of the periodic table, and from 0.5 to 15% of lead, the balance being copper.

10. A swash-plate type compressor according to claim 4, wherein said copper-based alloy further comprises less than 5% (not including zero %) of tin.

11. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy consisting essentially of from 0.5 to 8% of manganese, from 0.1 to 4% of silicon, from 0.5 to 15% of lead, and less than 5% but more than 0% of tin.

12. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which consists essentially of from 0.5 to 8% of manganese, from 0.1 to 4% of silicon and less than 5% (not including zero %) of tin, the balance being copper.

13. A swash-plate type compressor according to claim 12, wherein said copper-based alloy comprises 0.3 to 4% of silicon.

16. A swash-plate type compressor according to claims 1, 12, 2, 7, 15, 3, 4, 10, 11, 14, 5, 6, 8, 9, or 13, wherein a lubricating oil is supplied in said compressor in the state of a gaseous mixture with a refrigerant gas, alternating, sliding and thrust pressures ranging from 60 to 140 kg/cm$^2$ are applied to said shoes and said swash plate slides with respect to said shoes at a variable speed ranging from 2 to 25 m/second, and said copper-based alloy has a heat conductivity of 0.2 cal/cm$^2$/sec.°C. and a hardness of Hv 80 or more measured at a temperature of 300° C.

14. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, characterized in that said shoes consist of a copper-based alloy which consists essentially of from 0.5 to 8% of manganese, from 0.1 to 4% of silicon, less than 5% but more than 0% of tin, and not more than 1% in total of at least one element selected from the IVb group and the VIb group of the periodic table, the balance being copper.

15. A swash-plate type compressor according to claim 14, wherein said copper-based alloy further comprises from 0.5 to 15% of lead.

17. A swash-plate type compressor according to any claims, wherein the content of silicon is from 0.3 to 2.0%, and the content of manganese ranges from 1 to 5%.

18. A swash-plate type compressor according to claim 17, wherein the content of manganese ranges from 4 to 5%.

19. A swash-plate type compressor according to claims 1, 3, 10, 11 or 14, wherein the content of tin ranges from 1 to 3%.

20. A swash-plate type compressor according to claim 14 or 15, wherein the content of said at least one element selected from the IVb group and VIb group of the periodic table ranges from 0.2 to 0.8%.

21. A swash-plate type compressor according to claim 2, 4, 10 or 14, wherein said at least one element selected from the IVb group and VIb group of the periodic table is chromium.

22. A swash-plate type compressor according to claim 2, 8, 9, 10, or 14, wherein said at least one element selected from the IVb group and VIb group of the periodic table is titanium.

23. A swash-plate type compressor according to claim 2, 3, 4, 10 or 14, wherein said at least one element selected from the IVb group and VIb group of the periodic table is zirconium.

24. A swash-plate type compressor according to claim 2, 4, 10 or 14, wherein said at least one element selected from the IVb group and VIb group of the periodic table is molybdenum.

25. A swash-plate type compressor according to claim 5, 7, 15, 3, 4, 10 or 14, wherein said at least one element selected from the IVb group and VIb group of the periodic table is tungsten.

26. A swash-plate type compressor according to claim 2, 7, 15, 3, 4, 10, or 14, wherein two elements are selected from the group consisting of chromium, titanium and zirconium.

27. A swash-plate type compressor according to claim 2, 7, 15, 3, 4, 10, or 14, wherein the elements selected from the IVb group and the VIb group of the periodic table are chromium, titanium and zirconium.

28. A swash-plate type compressor according to claims 1, 2, 7, 15, 3, 4, 10, 11 or 14, wherein said swash plate consists of an alloyed steel.

29. A swash-plate type compressor according to claims 1, 2, 7, 15, 3, 4, 10, 11 or 14, wherein said swash plate consists of a nodular graphite cast iron.

30. A swash-plate type compressor according to claims 15 or 14, wherein a lubricating oil is supplied in said compressor in the state of a gaseous mixture with a refrigerant gas, alternating, sliding and thrust pressures ranging from 60 to 140 $Kg/cm^2$ are applied to said shoes and said swash plate slides with respect to said shoes at a variable speed ranging from 2 to 25 m/second, and said copper-based alloy has a heat conductivity of 0.2 $cal/cm^2/sec.°C.$ and a hardness of Hv 80 or more measured at a temperature of 300° C.

* * * * *

UNITED STATES PATENT AND TRADEMARK OFFICE

CERTIFICATE OF CORRECTION

PATENT NO. : 4,307,998

DATED : December 29, 1981

INVENTOR(S) : Shozo Nakayama, et al

It is certified that error appears in the above—identified patent and that said Letters Patent is hereby corrected as shown below:

Column 9, line 40: "amount" should be --amounts--.

Column 13, Table II: (in the Title) "Resignation" should be --Designation--.

Column 17, line 59: before "more", insert --but--.

Column 19, line 1: "any" should be deleted.

Signed and Sealed this

*Twentieth* Day of *November 1984*

[SEAL]

*Attest:*

GERALD J. MOSSINGHOFF

*Attesting Officer*

*Commissioner of Patents and Trademarks*